United States Patent [19]

Bubley et al.

[11] 4,099,460

[45] Jul. 11, 1978

[54] TURRET INDEXING AND REGISTRATION MEANS FOR MULTI-COLOR PRINTER

[75] Inventors: Henry J. Bubley, Deerfield; Claude H. Oltra, Chicago; John R. Krutsch, Glenview, all of Ill.

[73] Assignee: American Screen Printing, Chicago, Ill.

[21] Appl. No.: 745,530

[22] Filed: Nov. 29, 1976

[51] Int. Cl.[2] ..... B41F 1/12; B41F 15/10; B41F 15/26; B41F 17/38

[52] U.S. Cl. ..... 101/44; 101/115; 101/126; 198/345

[58] Field of Search ..... 101/123, 126, 35, 38 R, 101/38 A, 115, 407 R, 407 A, 407 BP, 41, 43, 44; 198/345, 803, 859

[56] References Cited

U.S. PATENT DOCUMENTS

| | | | |
|---|---|---|---|
| 2,229,346 | 1/1941 | Shurley | 101/126 X |
| 2,603,178 | 7/1952 | Cahenzli et al. | 198/803 X |
| 2,613,595 | 10/1952 | Weldon | 101/126 X |
| 2,694,973 | 11/1954 | Shoemaker | 101/126 |
| 2,761,540 | 9/1956 | Allen et al. | 198/345 |
| 3,416,440 | 12/1968 | Miller et al. | 101/35 |
| 3,501,023 | 3/1970 | Seragnoli | 198/859 X |
| 3,525,303 | 8/1970 | Cummings | 101/123 X |
| 3,596,704 | 8/1971 | Roe | 198/345 X |
| 3,795,189 | 3/1974 | Jaffa | 101/126 X |

*Primary Examiner*—Ronald E. Suter

*Attorney, Agent, or Firm*—Robert E. Wagner; Gerald T. Shekleton

[57] ABSTRACT

A multicolor printing apparatus for automatically screen printing cut piece textile goods and finished garments in diverse colors having a plurality of printing machines, each printing machine operatively positioned at a station about a turntable which is rotated by an indexer to successively present each platen on the turntable at each station. After being indexed at a particular station the turntable is locked into a registered position for the duration of the printing cycle, after which the locking bar is disengaged allowing the indexer to rotate the turntable and the platens to the next station.

2 Claims, 6 Drawing Figures

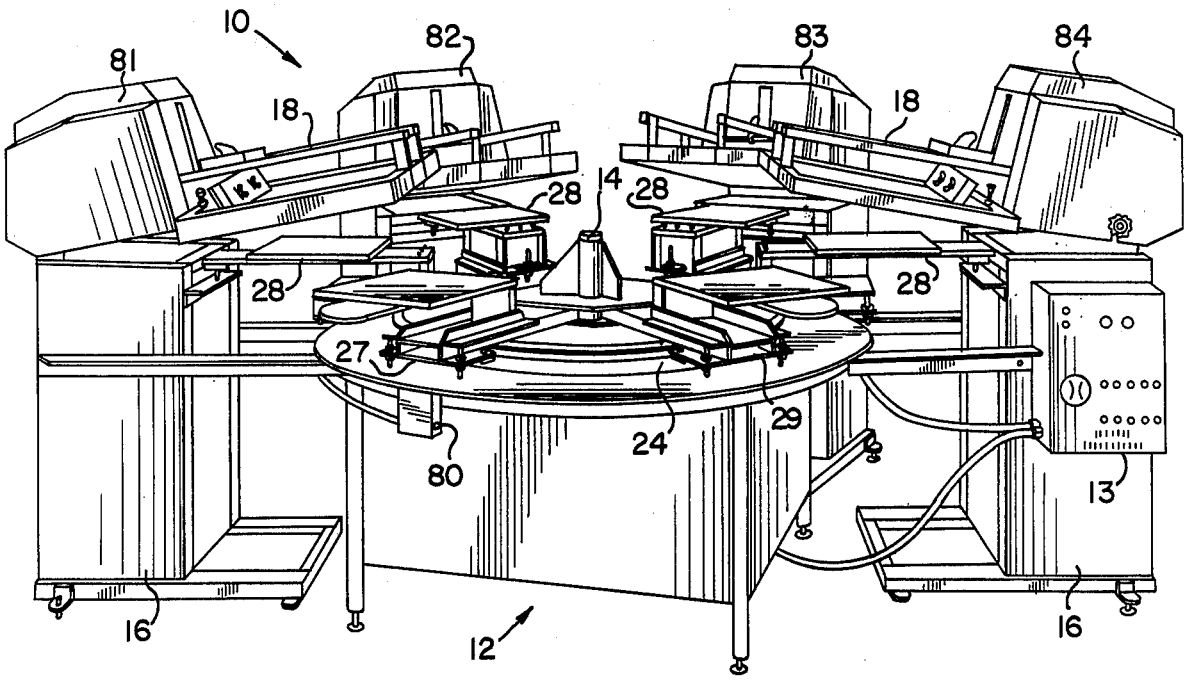
FIG. 1
FIG. 3
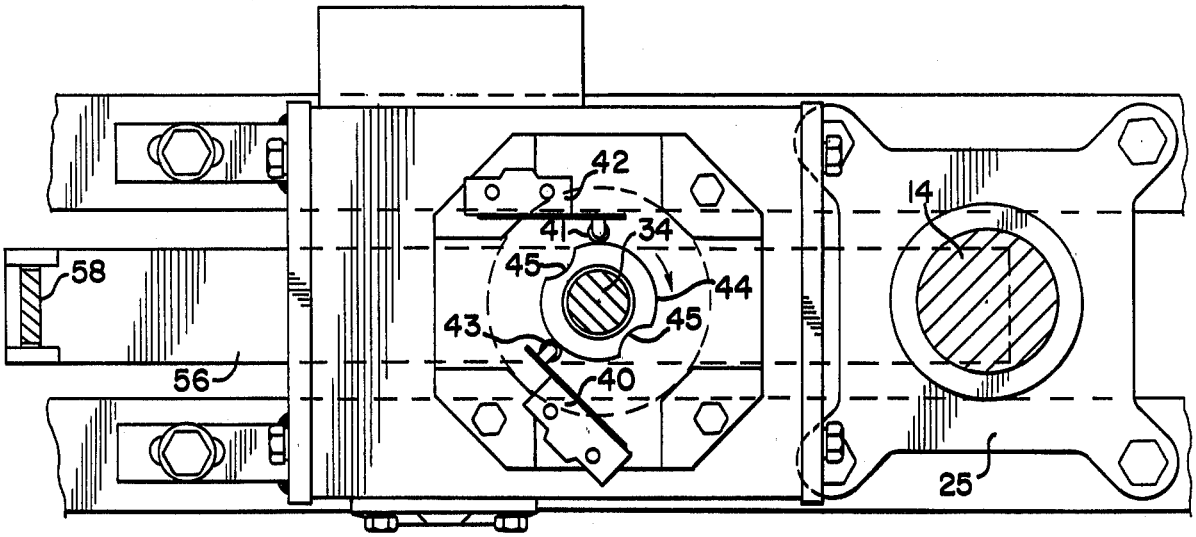

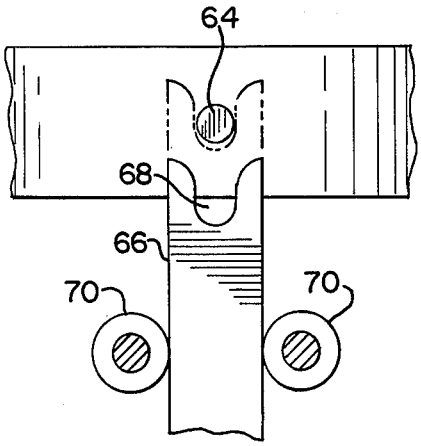
FIG. 4
FIG. 5
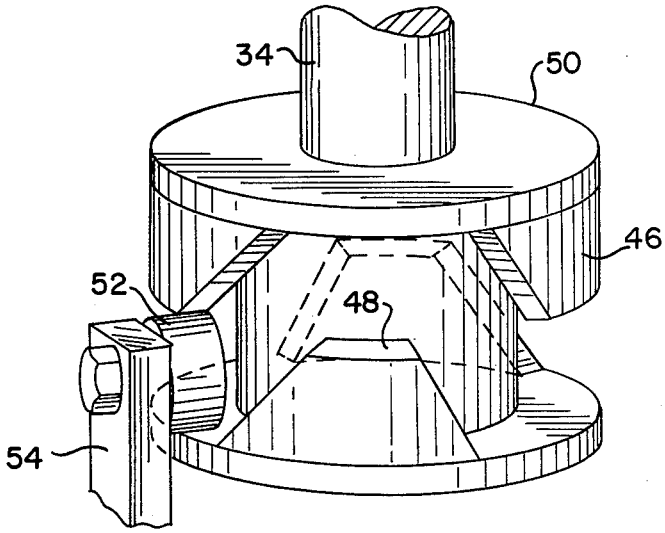
FIG. 6
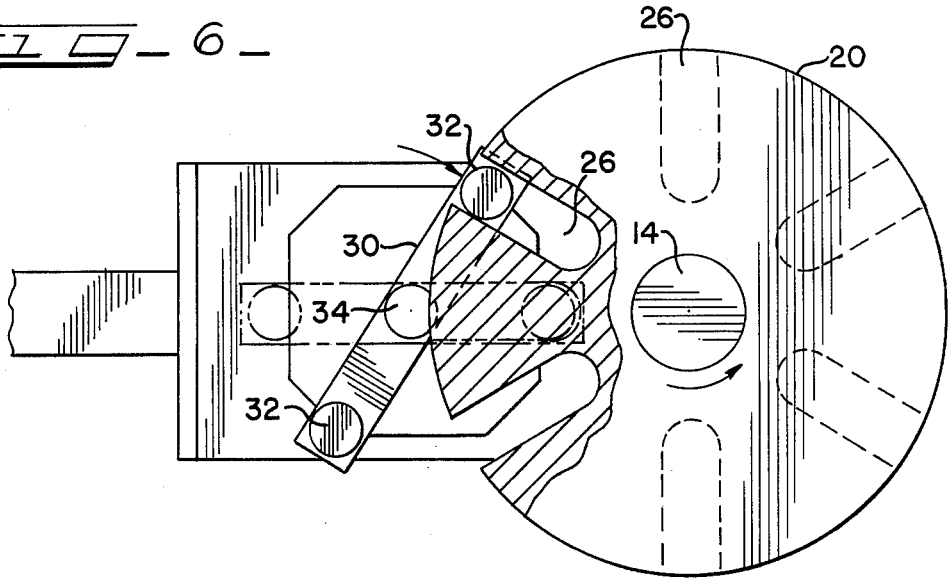

TURRET INDEXING AND REGISTRATION MEANS FOR MULTI-COLOR PRINTER

BACKGROUND OF THE INVENTION

This invention relates to a multicolor printing apparatus and, more particularly, to a new improved printing apparatus which permits cut piece textile goods and unfished garments to be automatically screen printed in diverse colors with speed and accuracy thereby precluding time consuming hand registration or manual handling between printing stations.

Various methods have been used in the prior art for multicolor printing of cut textile pieces and finished garments, including manual and automatic operation. In either of these methods the basic problem of registration of the piece to be printed remains the same. In the manual operation, registration is achieved by hand at each individual station, and is chiefly dependent upon the operator's skill and speed in registering the object. In the automatic method, registration presents a different, though related problem. Not only must the work piece be accurately registered initially on the platen, but also each platen must itself be accurately registered to each successive printing machine in the printing cycle. To accomplish the initial registration of the work piece on each platen during and between each successive printing station, a light adhesive coating is generally applied to the platen, onto which the work pieces may then be accurately registered by hand. The light adhesive coating grips the work piece and retains it in place on the platen. However, the difficulty of registering the platen to each individual printing station still remains, due to the imprecision inherent in all commonly used drive means. Registration of the platens to each printing station is, at best, correspondingly imprecise.

Therefore, a need arises for a precise and inexpensive method of registering and locking the platen to each successive printing station of a multicolor printing assembly. The subject invention accomplishes the necessary precise registration with a rotatable multiplaten assembly utilizing a unique indexing and locking means. With the subject invention it is possible to print five to seven different colors in substantial registration with one another, quickly and accurately. The subject indexer rotates the platens in unison to each successive printing station where a locking means engages and registers each platen at each station. Each printing press then prints that portion of the desired message or design on the selected color upon the registered object.

The ability of the subject invention to register and index a plurality of individual platens at successive stations in a printing operation permits selection of those printing presses which are most suitable for a particular application.

The indexer of the subject invention rotates a table about a central shaft or axis on which are mounted a plurality of equally spaced platens. The indexer includes a drive means which rotates an output shaft, at one end of which is connected a drive arm, which has rollers extending at right angles to the drive arm at opposite ends of the arm. Attached to the central shaft for revolution about the axis is a drive disc or wheel, having equally spaced, radially extending slots for accepting the rollers of the drive arm. As the drive arm rotates, a roller enters a slot and, continuing the drive arm's rotation about the output shaft, the roller urges the drive wheel in a circular motion until it emerges from the slot. The table and the plurality of platens are rotated by the drive wheel to the next station for the next step in the printing operation.

The registration of each platen at each station is accomplished by the locking mechanism. Pins extend from the circumference of the table at selected intervals. The locking mechanism comprises a latch having a recess for engaging these pins to register the platens to each station. The close conformance of the pin to the latch recess assures accurate registration. The latch engages and disengages the pin in a vertical fashion and is attached to its lower end to a lever arm which is pivoted at the opposite end. Between the ends of the lever arm is provided a cam follower which operates with a captivated cam revolving about the axis of rotation of, and in cooperation with the output shaft. In following the captivated cam the latching means is caused to reciprocate in a vertical fashion in conjunction with the start and finish of a half-rotation of the output shaft. Thus, as the roller of the drive arm enters a slot of the drive disc or wheel, the latching means quickly drops, releasing the table for rotation in conjunction with the urging of the drive arm. Upon the exit of the roller from the slot of the drive wheel, the latching means engages the registration pin on the succeeding platen, again registering all platens at each station. This sequence is repeated continuously. As each roller emerges from the slot, the opposite roller is in position to enter the next slot, after the printing is accomplished at that station.

The new and improved multicolor screen printing assembly provides considerable advantages in the manufacture and operation of the machine because of the reduced number of parts and simplicity of design. This, of course, contributes to the reduced cost of manufacture and maintenance and enlarges the number of applications of the machine.

It is therefore an object of the present invention to provide a new and improved multicolor printer which will allow the quick and accurate successive printing of a plurality of colors on a single object.

It is a further object of this invention to provide a new and improved multicolor printer of simplified design which is adaptable to a wide variety of uses.

It is a still further object of this invention to provide a multicolor printer in which the platen will be accurately registered during each printing cycle.

DESCRIPTION OF THE DRAWINGS

Further objects of the invention, together with additional features contributing thereto and advantages accruing therefrom will be apparent from the following description of one embodiment of the invention when read in conjunction with the accompanying drawings wherein:

FIG. 1 is a perspective view of the improved multicolor printing apparatus of the present invention.

FIG. 3 is a cross sectional view taken along the lines 3—3 of FIG. 2 showing the switching means for controlling the timed relationship of the printing cycle with the rotation of the table.

FIG. 4 is a side view taken along the lines 4—4 of FIG. 2 showing a portion of a locking means with the locked position in relief.

FIG. 5 is a perspective view of the closed cam arrangement for operating the locking means.

FIG. 6 is a cross section taken along the lines 6—6 of FIG. 2 showing the drive means and the drive wheel.

Referring now to FIG. 1 there is shown a multicolor printing assembly including a turntable assembly 12 having a turntable 24 revolving about a central shaft or axis 14, thereby presenting each station 28 successively at each of printing machines 81, 82, 83 and 84 for the printing of the desired messages or designs or portions of messages or designs on the textile fabric.

Figure 2:
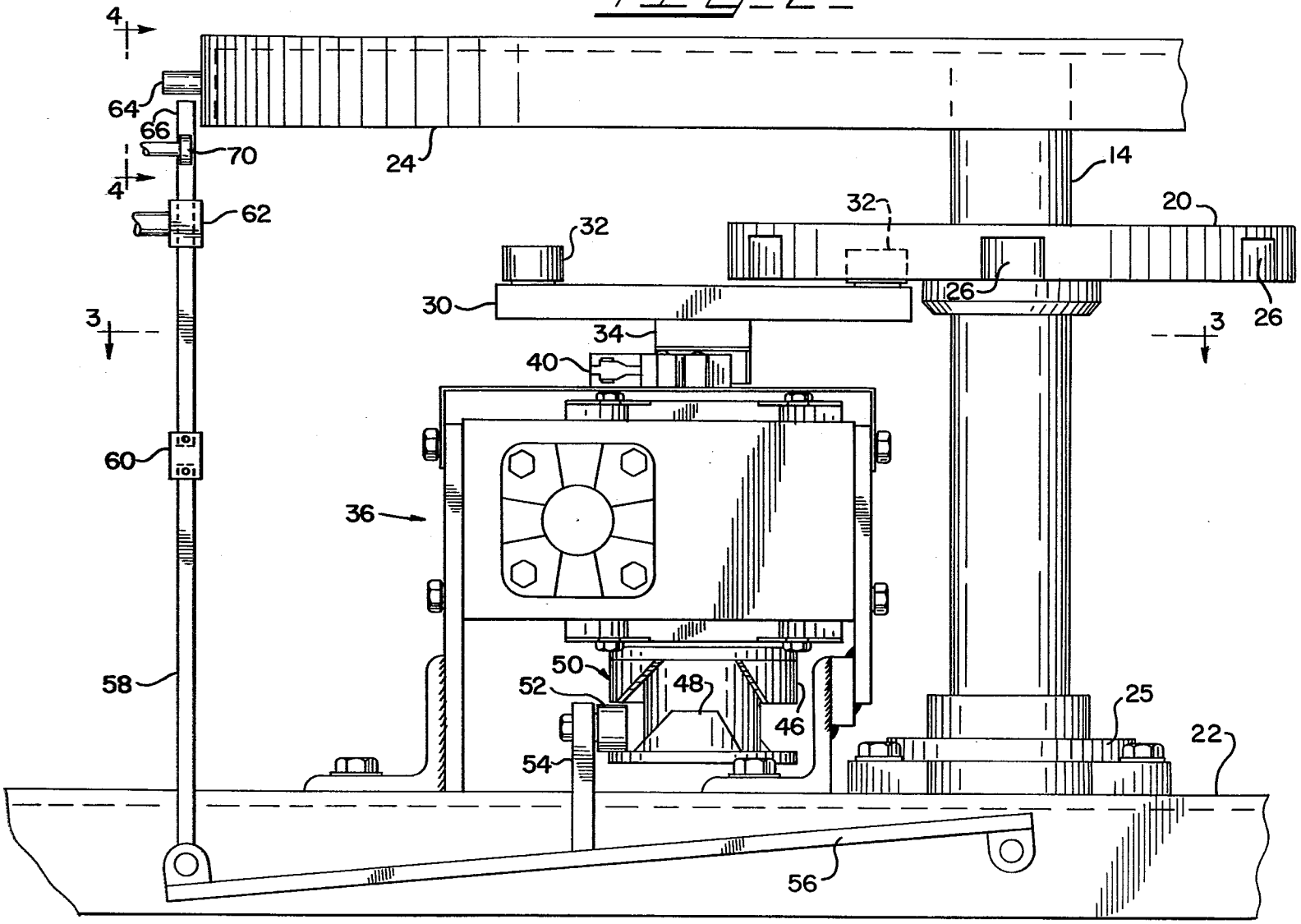
FIG. 2 is a side view of the improved multicolor printing apparatus of the subject invention showing the indexing means and locking means.

Operation of the entire assembly may be controlled from control panel 13, from which each of the printing machines 81, 82, 83 and 84 may be separately operated. In addition, a separate control switch 80, for the entire assembly, is also located beneath loading station 27 for convenience.

While FIG. 1 shows six individual stations having the capability of printing a four color design, it is understood that up to eight stations may be employed, in a manner to be described, to increase the number of colors printed to as many as seven different colors.

As shown in FIG. 2, the turntable 24 revolves about, and is supported by, a central shaft 14. The central shaft is mounted on the turntable assembly base 22 for rotational movement through suitable bearings in mounting 25. Mounted on the central shaft 14, for rotation about the same axis, is drive wheel 20. Slots 26 are formed in the drive wheel 20 beginning at a point spaced from the center shaft 14 and extending to the periphery of the drive wheel 20. In the embodiment shown, there are six slots 26, each equally spaced about the drive wheel and forming 60° angles with adjacent slots. The slots 26 are closed on three sides and open on the bottom.

To provide the capability of printing up to seven colors, an eight station embodiment of the subject invention is possible. The turntable in such an eight station embodiment has eight slots, each forming a 45° angle with adjacent slots. Other differences form the six station embodiment of the subject invention will be made apparent.

A drive arm 30 is mounted for rotational movement about a drive or output shaft 34 on a plane parallel to that of the drive wheel 20. On opposing ends of the drive arm 30 are attached rollers 32. The rollers 32 extend upwardly from the drive arm 30, and during one segment of the rotational cycle of the drive arm 30, a roller 32 fits within a slot 26 of the drive wheel 20. While shown in FIG. 2 as being positioned below the drive wheel 20 with the rollers 32 extending up to engage the slots 26, it is obvious that the drive arm could be located above the drive wheel with the rollers extending downward to engage the correspondingly reversed slots on the drive wheel. As shown in FIG. 6, the drive arm 30 rotates in a clockwise manner and as the roller 32 enters the slot 26, as a result of the drive arm rotation, the drive wheel 20 is urged in a counterclockwise direction by the roller 32, which penetrates the slot until the position, shown in dotted lines in FIG. 6, is reached. At that point the roller 32 begins its egress from the slot 26, thereby urging the drive wheel 20 from the point of penetration to the point of egress from the slot in a counterclockwise direction. To accommodate the eight station embodiment of the subject invention with its correspondingly smaller angles presented by these slots, the drive arm will necessarily be of a shorter length.

The drive arm 30 is driven about the drive shaft 34 by a variable speed motor 36, which, through an appropriate reduction gear box of known type, produces power at the output shaft 34 at a selected speed. The output shaft has a collar 44 with a peripheral switch-camming surface comprising a pair of detents 45 diametrically opposite one another on the collar 44. A pair of limit switches 40 and 42 are located around the shaft 34 and have rollers 41 and 43 which follow the camming surface of the collar 44. Limit switch 42 controls the rotation of the output shaft 34 by its following motion on the camming surface of the collar 44. Every one-half rotation of the drive shaft 34 causes the roller 41, of the limit switch 42, to enter a detent 45, thereby switching off the electrical circuitry to the motor and stopping rotation of the drive shaft 34. Limit switch 40, by its roller 43, is also responsive to the camming surface of the collar 44, controlling the printing cycle of the printing machine at each station. The output shaft switch 42 is located about the shaft, relative to print cycle switch 40, so that it is in a following mode, that is, as the output shaft rotates in a clockwise direction, the print cycle switch 40 is activated prior to activation of output shaft switch 42.

Every printing cycle is brought about in the following manner well known to those in the art by a 180° rotation of the shaft. The motor 36 is turned on at starting switch 80, rotating the output shaft 34 until the limit switch 40 encounters a detent 45 in the cam collar 44, which controls the printing cycle, the output shaft 34 continues rotation until switch 42 engages a detent 45 and stops rotation of the shaft 34. At this point, the turntable 24 is indexed and locked in a registered position and remains stationary until the printing cycle ends. At the end of the printing cycle, the output shaft begins rotation to start another printing cycle as described.

Operating in a timed relationship with the output shaft 34 and the turntable 24, is a locking means which registers and locks the turntable 24 in the correct position upon the indexing of the turntable 24 to the succeeding station. This locking means is actuated by a camming means attached to the output shaft 34 for following rotational movement. A roller 52 is captivated by the cam 50 for following the cam rises 48 and falls 46. This following vertical movement by the roller 52 is translated to a rod 56 by an arm 54. The rod 54 is pivoted at one end and a locking bar 58 is attached at the opposite end for vertical movement. A guide collar 62 and guide rollers 70 maintain the locking bar 58 in a constant position relative to the turntable 24. The locking portions 66, of the locking bar 58, encounters the locking pins 64, on the turntable 24, in a manner which will be described. A height adjusting device 60 is included on the locking bar 58 to assure accurate placement of the locking portion 66, of the locking bar 58, on the pin 64.

Oscillatory vertical movement is imparted to the locking bar 58, through the following of the roller 52, on the camming surface of the captivated cam 50. As the output shaft 34 turns, thereby rotating the cam 50, the roller 52 engages and ascends the cam rises 48, thereby pivoting and elevating the rod 56 to push the locking bar 58 upward through the guide collar 62, to engage the locking portion 66 with the locking pin 64. Upon further rotation of the cam 50, the roller contacts the cam falls 46 which forces the roller 52 downward, depressing the rod 56 and the locking bar 58, thereby disengaging the locking portion 66 from the locking pin 64.

It is essential that the cam rises 48 be positioned exactly 180° opposite one another and that the cam falls 46 also be positioned in such a manner. Further, the cam 50 itself must be positioned about the drive shaft in such an exact relationship with the camming collar 44, that, upon actuation of the limit switch 42 upon entry into the detent 45, the roller 52 encounters and ascends the cam rises 48, thereby elevating the locking bar 58 so that the locking portion 66 engages the locking pin 64. At the end of the print cycle and concurrent with the commencement of the rotation of the drive arm, the roller 52 encounters cam falls 46 and decends, thereby lowering the locking bar 58 and disengaging the pin 64. Naturally, the locking bar must disengage the locking pin 64 prior to movement of the turntable in the indexing cycle. Thus, it becomes imperative that the camming means 50 provide a positive response for the roller 52 to follow and that this response be immediately prior to any movement of the drive wheel caused by the urging of the drive arm 30.

In operation then, a textile garment such as a T-shirt, is placed on a platen at the loading station 27 and registered by conventional means as described. The printing assembly of the subject invention is turned on at the control panel 13 or switch 80, and printing press 81 is turned on, leaving the remaining presses temporarily inoperative. Immediately the locking bar 58 drops, releasing the locking pin 64 while the drive arm 30 urges the drive wheel 20, through the action of the roller 32, in the slot 26 of the drive wheel. Upon exit from the slot 26 by the roller 32, each platen on the turntable is indexed at a separate station whereupon the rotation of the drive shaft 34 causes the cam roller 52 to engage the cam rises 48 of the captivated cam 50, thereby forcing the locking portion of the locking bar 58 upward to engage the locking pin 64 and register the turntable so that each platen is registered to each station. At this point, roller 41, of limit switch 42, enters the detent 45, of the camming collar 44, stopping rotation of the drive shaft 34. The printing cycle is started by limit switch 40, thereby printing the desired design or portion of a message or design on the T-shirt on the next platen. At the conclusion of the printing cycle, the drive shaft 34 begins rotation, thereby indexing the turntable to the succeeding station. Concurrent with the starting of the turntable, as before, the locking bar 58 disengages the locking pin 64 allowing rotation of the turntable. Prior to this printing cycle, the operator turns on press 82 at the control panel 13. After the turntable is indexed and registered as described, press 81 prints its particular design on the second shirt while press 82 is printing yet another design on the T-shirt initially registered. In this manner, each press is turned on as the turntable makes a complete revolution. After the last printing cycle is completed on a T-shirt, unloading station 29 is reached where a second operator removes the shirt. This operation remains the same regardless of whether the six station embodiment or eight station embodiment is used.

However, another printing station may be added to the embodiment shown, thereby causing the loading station and unloading station to be combined into one station.

While the invention has been described with reference to a preferred embodiment it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

We claim:

1. In a printing assembly having a turntable, a frame, said turntable being supported on a support means, said support means mounted at one end thereof in said frame to provide for rotation of said turntable, a plurality of printing stations spaced about the periphery of said turntable, a corresponding number of printing machines being operatively positioned at each of said spaced printing stations, and a plurality of platens at least equal to the number of printing stations, each platen supported on said turntable, the improvement comprising indexing means and locking means for successively indexing, registering and locking said platens at said stations prior to a printing cycle and having a drive shaft mounted on said turntable frame, said drive shaft rotatable about a central axis thereof, an actuating means disposed about said drive shaft and responsive to the rotation of said drive shaft, a drive arm mounted on said drive shaft for rotation therewith, said drive arm having a first roller means and a second roller means mounted on opposite ends thereof, a drive wheel concentrically mounted about said turntable support means, each of said first and second roller means being operatively engageable with said drive wheel to rotate said turntable in a continuous series of increments, such that in each increment of rotation, said turntable is moved until said actuating means stops rotation of said drive shaft after a preselected angular distance and said locking means operates in conjunction with said indexing means to register and lock said turntable prior to initiation of said printing cycle to assure that each platen is positively locked into a desired position and is accurately registered at each station during each said printing cycle, said locking means having a locking pin fixedly mounted on the periphery of said turntable at each station, a locking bar, a rod, said rod pivotally mounted at a first end thereof to said frame, an arm, said arm extending from said rod and captivated in a cam, said cam mounted concentrically on said drive shaft for rotation therewith, said rod being connected to said locking bar at a secoond end thereof, said cam rotating to drive said locking bar vertically to engage said locking pin and guide means fixedly positioned at at least one of said stations to direct the vertical movement of said locking bar in the engagement of said locking pin to assure accurate and positive registration of said turntable.

2. The printing machine of claim 1 wherein said actuating means comprise at least two micro-switches poised about said drive shaft, said micro-switches being responsive to the rotation of said drive shaft to generate signals for stoppoing the rotation of said table and initiating said printing cycle.

* * * * *